US005460027A

United States Patent [19]

Takahashi

[11] Patent Number: 5,460,027

[45] Date of Patent: Oct. 24, 1995

[54] PUNCH CLAMP DEVICE

[75] Inventor: Yukio Takahashi, La Habra, Calif.

[73] Assignee: Amada Engineering & Service Co., Inc., La Mirada, Calif.

[21] Appl. No.: 297,127

[22] Filed: Aug. 29, 1994

[51] Int. Cl.[6] ..... B21D 37/14

[52] U.S. Cl. ..... 72/481; 72/389; 72/462; 269/254 R

[58] Field of Search ..... 72/389, 462, 481, 72/482; 269/254 R, 277

[56] References Cited

U.S. PATENT DOCUMENTS

| | | | |
|---|---|---|---|
| 2,604,739 | 7/1952 | Evans | 269/254 R |
| 4,315,425 | 2/1982 | Zbornik et al. | 72/481 |
| 5,022,256 | 6/1991 | Van der Meulen | 72/481 |

FOREIGN PATENT DOCUMENTS

| | | | |
|---|---|---|---|
| 3136440 | 3/1983 | Germany | 72/481 |
| 4115224 | 11/1992 | Germany | 72/481 |
| 42121 | 2/1991 | Japan | 72/481 |
| 4220119 | 8/1992 | Japan | 72/481 |

*Primary Examiner*—David Jones
*Attorney, Agent, or Firm*—Irving Keschner

[57] ABSTRACT

A clamp device for securing a bending press punch on its punch holder, the clamp device being capable of securing punches having a straight, or flat, contacting surface and those having a groove on the contacting surface. The clamp device comprises a plurality of spring members each secured about a bolt; an upper punch clamp plate member having a punch contacting surface; and a lower flanged punch clamp plate member having a punch contacting surface. The spring members provide the force necessary to return the upper punch clamp plate member to a position wherein a portion thereof is within the groove when the grooved punch is used. When the flat surface punch is utilized, the punch contacting surface portion of the lower punch clamp plate member and the punch contacting surface of the upper punch clamp plate member are positioned against the contacting surface of the punch thus providing solid surface contact when either punch design is utilized.

12 Claims, 2 Drawing Sheets

FIG.4
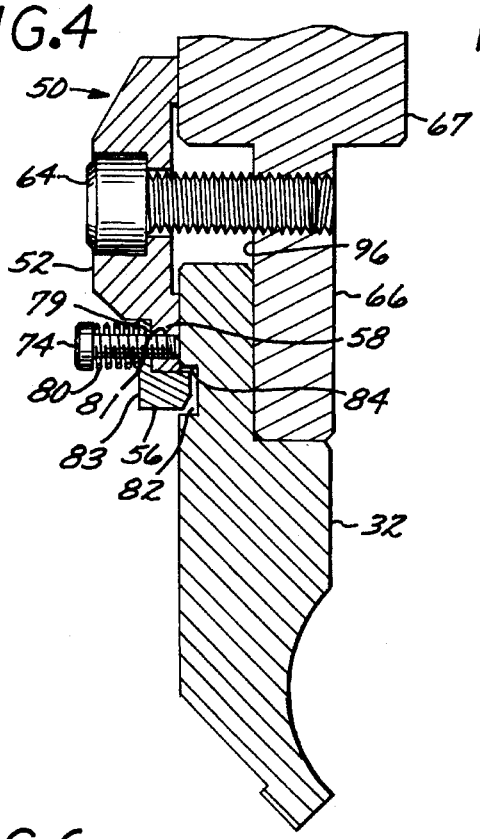
FIG.5
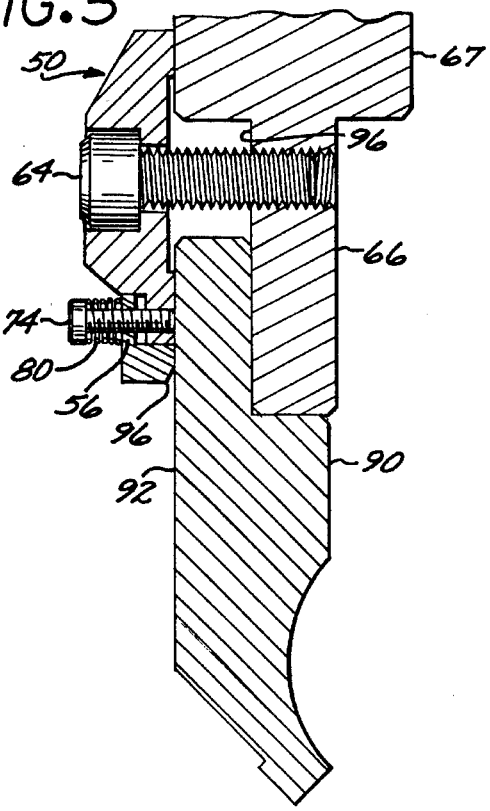
FIG.6
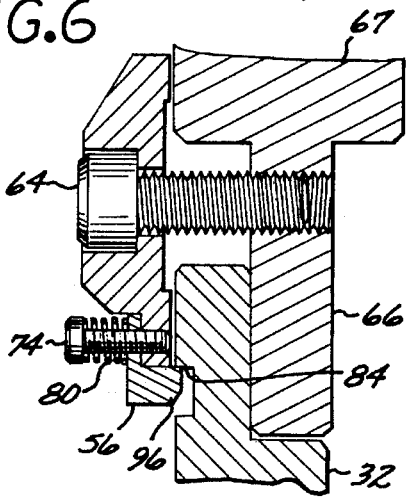
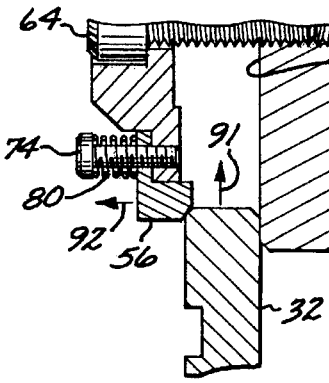
FIG.7
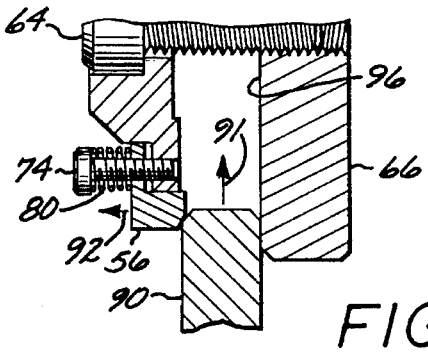
FIG.8

PUNCH CLAMP DEVICE

BACKGROUND OF THE INVENTION

1. Field of the Invention

The present invention provides a clamp member for securing either a punch, or tool, having a flat contacting surface or a contacting surface with a groove formed thereon to a bending press punch holder.

2. Description of the Prior Art

Currently, users of straight and grooved design punches must switch between two separate punch clamps to provide the necessary surface contact between the punch and punch clamp.

A patentability search developed the following patents disclosing various clamp plate members. In particular, U.S. Pat. No. 4,993,255 to Treillet discloses a clamping member designed to engage a grooved punch; Pat. No. 4,534,203 to Cros discloses a device for mounting punches on a bending press wherein a bearing spacer of variable dimensions is utilized to allow punches of different configurations to be mounted; Pat. No. 4,315,425 to Zbornik et al shows complex clamping assemblies for securing tools of various configurations; Pat. No. 4,895,014 to Houston and Pat. No. 4,787,237 to Houston et al disclose a punch support structure particularly adapted for use with grooved punches; French Patent No. 2339485 discloses a clamp plate member for supporting a grooved punch; French Patent No. 2427148 discloses a device for securing a hammer head type punch to the punch holder; Japanese Patent No. 267019 discloses a die clamping member for securing a grooved tool; and Japanese Patent No. 54524 discloses a clamping device for use in securing a metal die to the metal die fitting face.

The prior art clamping plate devices noted above are complex, particularly those designed to accommodate punches of different configurations, requiring increased levels of maintenance, the costs to a purchaser being increased as a result thereof.

What is therefore desired is to provide a clamping plate device which is simple in construction, inexpensive to manufacture and which allows both grooved and flat punches to be utilized with a press brake machine while maintaining sufficient surface contact between the punch and clamp plate.

SUMMARY OF THE PRESENT INVENTION

The present invention provides a clamp device for securing a bending-press punch on its punch holder, the clamp device being capable of securing punches having a straight, or flat, contacting surface and those having a groove on the contacting surface. The clamp device comprises a plurality of spring members each secured about a bolt; an upper punch clamp plate member having a punch contacting surface; and a flanged lower punch clamp plate member having a punch contacting surface. The spring members provide the force necessary to return the flanged upper punch clamp plate member to a position wherein a portion thereof is within the groove when the grooved punch is used. When the flat surface punch is utilized, the punch contacting surface of the lower punch clamp plate member and the punch contacting surface portion of the upper punch clamp plate member are positioned against the contacting surface of the punch thus providing solid surface contact when either punch design is utilized.

The present invention thus provides a simplified and inexpensive device for securing a grooved and flat punch on a brake press punch holder enabling the machine owner to purchase either punch based on availability and price.

DESCRIPTION OF THE DRAWINGS

For a better understanding of the invention as well as other objects and further features thereof, references made to the following description which is to be read in conjunction with the accompanying drawings wherein;

FIG. 4 is a cross-sectional view along line 4—4 of FIG. 3;

FIG. 5 is a cross-sectional view showing the clamp plate device of the present invention with a flat surface punch;

FIG. 6 is a cross-sectional view illustrating how the clamp plate device of the present invention prevents the grooved punch from falling from the holder; and FIGS. 7 and 8 illustrate in simplified form how the clamp plate of the present invention enables the simple insertion of the grooved and flat punch, respectively.

It is noted that the same reference numerals utilized in the figures identifying identical components.

DETAILED DESCRIPTION OF THE INVENTION

Figure 1:
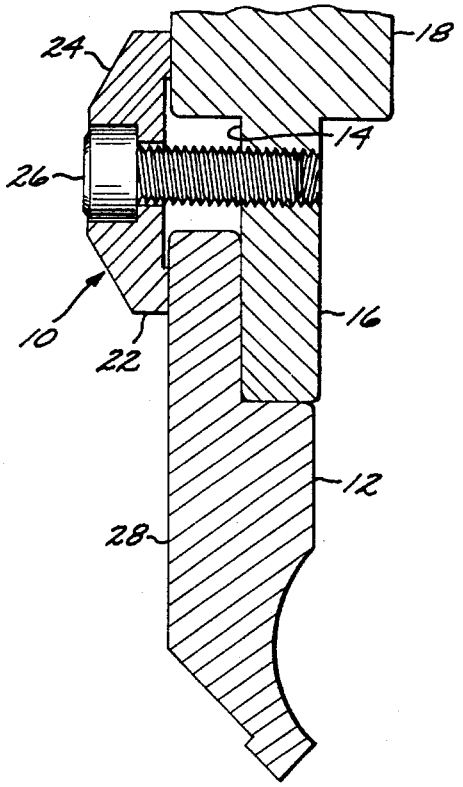
FIG. 1 PRIOR ART
FIG. 1 illustrates, in a simplified cross-sectional view, a prior art clamp plate for securing a punch on the platen of a bending-press, the clamp plate contacting a flat surface of the punch.

Referring now to FIG. 1, a prior art clamp plate 10 secures a conventional (know as the American) punch, or tool, 12 to the front surface 14 of attachment heel 16 of platen 18. The clamp plate 10 comprises flange portions 22 and 24 secured to punch 12 and platen 18, respectively, by bolt 26. Tightening of bolt 26 forces punch 12 into contact with surface 14 of heel 16 thus securing punch 12 to platen 18. In this prior art configuration, punch 12 has a flat surface 28 over its entire width.

Figure 2:
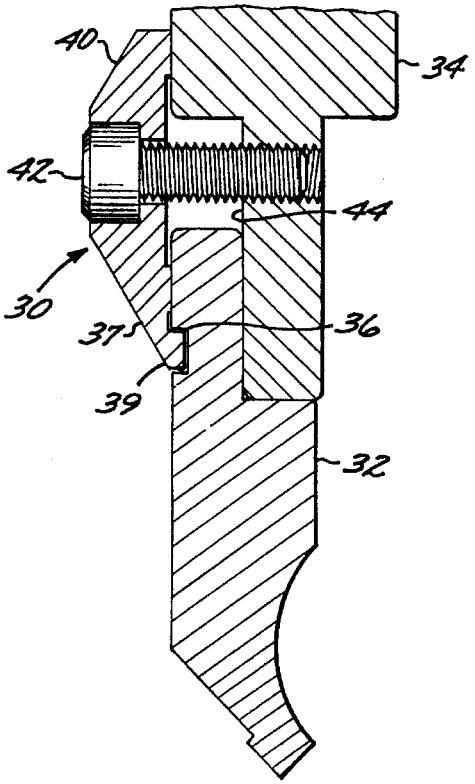
FIG. 2 PRIOR ART
FIG. 2 illustrates, in a simplified cross-sectional view, a prior art clamp plate for securing a punch on the platen of a bending-press, a portion of the clamp plate being positioned in a groove formed in the punch.

FIG. 2 illustrates the use of a clamp plate member 30 to secure punch 32 to platen 34. In this system, punch 32, known as the European punch, has a safety groove 36 formed therein. Clamp plate member comprises flange portions 37, 38 and 40 and bolt 42. Flange portion 38 is shaped to fit into groove 36. When bolt 42 is tightened, force is applied to punch 32 by contacting flange portion 37, forcing punch 32 into contact with surface 44 of heel 46 of platen 34 and securing punch 32 to platen 34, the positioning of flange portion 38 in groove 36 minimizing the risk that punch 32 will accidentally fall when the bolt 42 is loosened.

If a clamp plate of the type shown in FIG. 2 is used with punch 12 of FIG. 1, flange portion 37 will not contact punch surface 28 when bolt 42 is tightened, flange portion 38 making line, not surface contact, with surface 28. In essence, using clamp plate 30 with punch 12 reduces the clamp plate/punch surface contact area which in turn makes the punch more susceptible to loosening during the bending process with the attendant loss of accuracy of parts manufacture.

Figure 3:
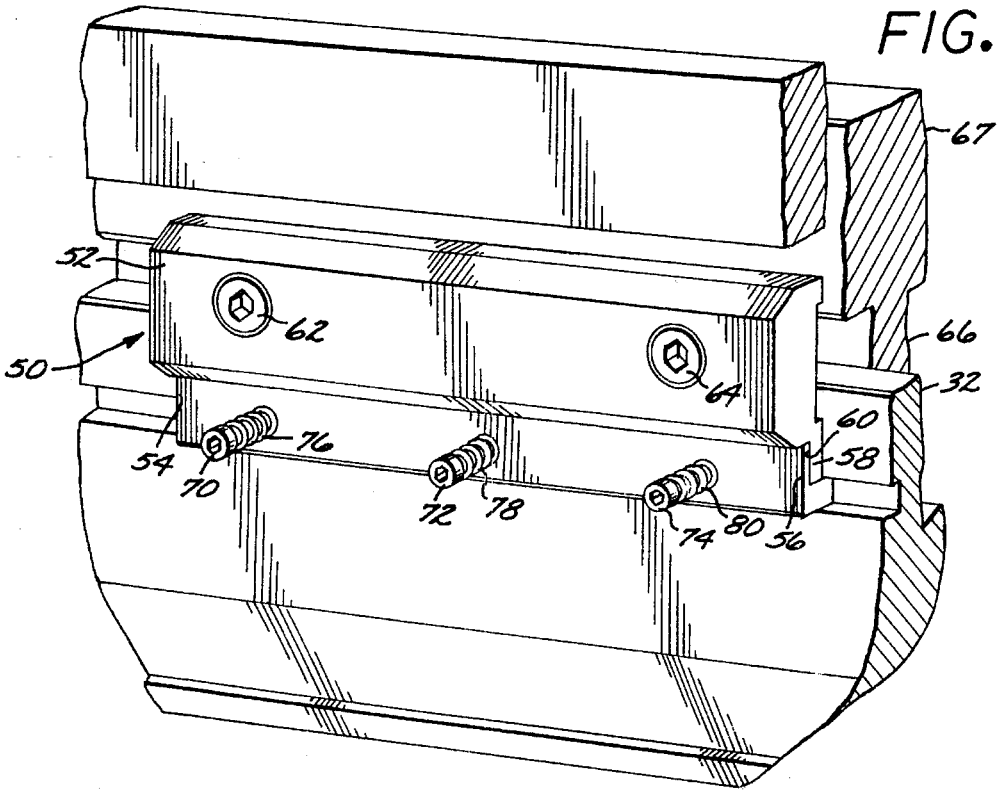
FIG. 3 is a perspective view of the clamp plate device of the present invention holding a punch.

FIG. 3 is a perspective view of the novel clamp plate device 50 of the present invention engaging a grooved punch 32. As will be explained in more detail hereinafter with reference to FIG. 4, device 50 comprises an elongated lower punch clamp flange member 52 having a step-like flange portion 58 and elongated upper L-shaped punch clamp flange member 54, leg 56 of the L-shaped member 54 being adapted to be seated on adjacent surface 60 of flange portion 52 when used in conjunction with punch 32 as will be explained hereinafter.

Bolts, or screws, 62 and 64 secure device 50 to heel portion 66 of platen 67 as illustrated. Three apertures are formed in leg 56 (only aperture 79 illustrated in FIG. 4), corresponding threaded apertures being formed in flange portion 58 (only aperture 81 being illustrated) of member 52. Three threaded bolts, or pins, 70, 72 and 74 having head and shaft portions, are positioned through the apertures in leg 56 and threaded into coaligned apertures formed in flange portion 58. Coil springs 76, 78 and 80 are positioned about bolts 70, 72 and 74, respectively, in a manner such that one end of each spring is secured below the head of the bolt it is mounted on, the other spring end being in contact with surface 83 of member 54. When device 50 is utilized with the grooved punch 32, threading of bolts 70, 72 and 74 into their associated apertures in flange portion 58 until punch 32 is secured against the bearing surface of heel 66 allows compression springs 76, 78 and 80 to maintain the lower surface of leg 56 in contact with adjacent surface 60 of flange portion 58. In the position shown, portion 56 is within groove 82 forming a locking-joint to eliminate the accidental dropping of the punch 32 when bolts 62 and 64 are loosened. In particular, positioning portion 56 within groove 82 a distance sufficient so that surface 84 of groove 82 engages the adjacent surface of flange portion 56 prevents complete dropping when the bolts 62 and 64 are loosened.

FIG. 5 shows the punch clamp 50 of the present invention when used with a straight design punch 90. In this case, when the bolts 62 and 64 are tightened, portion 56 retracts a distance along the shafts of pins 70, 72, and 74 and forces springs 76, 78, and 80, respectively, to be compressed. The tightening of bolts 62 and 64 continues until the threading action stops at which time portion 56 is in contact with surface 92 of punch 90. Punch 90, in turn, is secured against the bearing surface of heel 66. Chamfer 76 on portion 56 eases the insertion of punches 32 and 90 into the punch holder.

FIG. 6 illustrates how the inner surface of flange portion 56 still contacts groove surface 84 to the extent that punch 32 is prevented from being released from the punch holder even after bolts 62 and 64 are loosened.

FIGS. 7 and 8 illustrate, in simplified form, how punches 32 and 90, respectively, are easily inserted into their punch holders. In particular, by forcing the punches in the direction of arrow 91, flange portion 56 is moved in the direction of arrow 92 along the shaft of bolts 70, 72, and 74 (only bolt 74 illustrated), compressing springs 76, 78 and 80 (only spring 80 illustrated) and allowing the punches to be moved into operating position against edge 96 of heel 66 as shown in FIGS. 4 and 5.

FIGS. 7 and 8 illustrate the initial position of flange portions 52 and 54 prior to insertion of either punch 32 or 90.

The present invention thus allows owners of straight and grooved design punches to use a single clamp plate while still enjoying superior surface contact between both parts, thereby reducing set up time and the attendant reduction in manufacturing costs.

While the invention has been described with reference to its preferred embodiment, it will be understood by those skilled in the art that various changes may be made and equivalence may be substituted for elements thereof without departing from the true spirit and scope of the invention. In addition, many modifications may be made to adapt to a particular situation or material to the teaching of the invention without departing from its essential teachings.

What is claimed:

1. An improved punch clamp device for securing a punch to a platen of a bending press comprising:

a first elongated member having a step-like portion—said step-like portion having a first surface and plurality of first apertures formed along the length thereof;

a second elongated, L-shaped member having first and second leg portions, said first leg portion being adapted to overlie a surface of the step-like portion of said first elongated member, a plurality of second apertures being formed in said first leg portion of said elongated, L-shaped member, said second plurality of apertures being coaligned with corresponding ones of said first plurality of apertures;

a plurality of fastener members extending through said first and second plurality of coaligned apertures; and a plurality of spring members mounted on said fastener means for enabling said L-shaped member to be in either a first or second operating position.

2. The clamp device of claim 1 wherein said L-shaped member is in said first operating position when said punch has a groove in one surface thereof.

3. The clamp device of claim 1 wherein said punch has a flat surface, said L-shaped member being in said second operating position when the second leg portion thereof contacts the flat surface of said punch.

4. The clamp device of claim 1 wherein said second apertures are threaded.

5. The clamp device of claim 1 wherein said fastener devices have head and shaft portions, said spring members being adapted to be mounted on the shaft of said fastener devices and positioned between the fastener head and said first surface of said first leg of said L-shaped portion.

6. The clamp device of claim 2 wherein the second leg of said L-shaped member has a portion which is adapted to extend into the punch groove.

7. A device for rigidly fixing a punch of elongated shaped to the platen of a bending press, said platen having a vertical surface adapted to provide a bearing surface for a matching reference surface of a heel of the platen comprising:

a first elongated flange member having first and second portions, a first surface of said first portion adapted to contact a first surface of said punch; a second surface of said punch being in contact with said platen vertical bearing surface;

fastener means for securing said second portion of said first elongated flange member to said platen;

an L-shaped elongated member having first and second leg portions, a first surface of first leg portion being adapted to be in contact with the second surface of said first portion of said first elongated member when said punch is of a first configuration, a plurality of apertures being formed along the length of said second leg portion, a plurality of apertures being formed in said first portion of said first elongated flange member;

a plurality of joining members extending through the apertures formed in said L-shaped member and into the coaligned apertures formed in said first portion of said first elongated flange member; and a plurality of spring members mounted on each of said joining members.

8. The device of claim 7 wherein said L-shaped member is in said first operating position when said punch has a groove in one surface thereof.

9. The device of claim 7 wherein said punch has a flat surface, said L-shaped member being in said second operating position when the second leg thereof contacts the flat surface of said punch.

10. The device of claim 7 wherein the apertures formed in said first portion of said first elongated flange member are threaded.

11. The device of claim 7 wherein said joining members have head and shaft portions, said spring member being adapted to be mounted on the shaft of a joining member and positioned between the head portion and the other surface of said second leg portion.

12. The device of claim 8 wherein the second leg of said L-shaped member has a portion which is adapted to extend into the punch groove.

* * * * *